US007584741B2

(12) United States Patent
Thomas et al.

(10) Patent No.: US 7,584,741 B2
(45) Date of Patent: Sep. 8, 2009

(54) INTERNAL COMBUSTION ENGINE WITH ROTARY VALVE

(75) Inventors: Andrew Donald Thomas, North Epping (AU); Anthony Bruce Wallis, Gladesville (AU); Glenn David Horrocks, Marsfield (AU)

(73) Assignee: Bishop Innovation Limited, North Ryde (AU)

( * ) Notice: Subject to any disclaimer, the term of this patent is extended or adjusted under 35 U.S.C. 154(b) by 0 days.

(21) Appl. No.: 11/660,004

(22) PCT Filed: Aug. 31, 2005

(86) PCT No.: PCT/AU2005/001307

§ 371 (c)(1),
(2), (4) Date: Feb. 12, 2007

(87) PCT Pub. No.: WO2006/024082

PCT Pub. Date: Mar. 9, 2006

(65) Prior Publication Data

US 2007/0266983 A1 Nov. 22, 2007

(30) Foreign Application Priority Data

Sep. 1, 2004 (AU) ..... 2004704981

(51) Int. Cl.
*F02B 31/00* (2006.01)
*F01L 7/00* (2006.01)
*F02P 15/00* (2006.01)

(52) U.S. Cl. ..... 123/309; 123/636; 123/661; 123/190.1

(58) Field of Classification Search ..... 123/190.1, 123/190.4, 59.1, 80 BA, 309, 190.6, 190.8, 123/636, 661
See application file for complete search history.

(56) References Cited

U.S. PATENT DOCUMENTS

| | | | | |
|---|---|---|---|---|
| 2,211,288 | A * | 8/1940 | Oesch | 123/190.8 |
| 3,945,364 | A | 3/1976 | Cook | |
| 3,948,227 | A | 4/1976 | Guenther | |
| 4,008,694 | A | 2/1977 | Monn | |
| 4,404,934 | A | 9/1983 | Asaka et al. | |
| 4,852,532 | A | 8/1989 | Bishop | |
| 5,327,864 | A * | 7/1994 | Regueiro | 123/260 |
| 5,509,386 | A | 4/1996 | Wallis et al. | |
| 5,526,780 | A * | 6/1996 | Wallis | 123/190.6 |
| 5,819,700 | A | 10/1998 | Ueda et al. | |
| 5,908,016 | A | 6/1999 | Northam et al. | |
| 6,601,379 | B1 * | 8/2003 | Tomczyk | 60/39.6 |

(Continued)

FOREIGN PATENT DOCUMENTS

WO WO-96/32569 A1 10/1996

(Continued)

*Primary Examiner*—Hai H Huynh
(74) *Attorney, Agent, or Firm*—Birch, Stewart, Kolasch & Birch, LLP

(57) ABSTRACT

An axial flow rotary valve for an engine, that is rotatable about an axis within the bore of a cylinder head. The valve communicating with a respective cylinder in which a piston reciprocates, and an ignition means associated with the cylinder. The valve is provided with inlet and exhaust peripheral openings that periodically communicate with cylinder through a window in the bore. A combustion chamber is formed in the space between the crown of the piston at top dead centre and the cylinder head and the valve. The ignition means comprising first and second spark plugs, each of said spark plugs having a nose located at one end thereof exposed to the combustion chamber, said noses being disposed on opposite sides of said window within the axial extremities of said window.

18 Claims, 12 Drawing Sheets

U.S. PATENT DOCUMENTS

| | | | | |
|---|---|---|---|---|
| 6,763,788 | B2 * | 7/2004 | Wallis | 123/80 BA |
| 6,994,067 | B2 * | 2/2006 | Wallis | 123/190.8 |
| 2004/0187831 | A1 * | 9/2004 | Bachelier | 123/190.1 |
| 2005/0274348 | A1 * | 12/2005 | Verdial | 123/190.4 |
| 2006/0102130 | A1 * | 5/2006 | Bachelier | 123/190.4 |
| 2006/0185640 | A1 * | 8/2006 | Barnes | 123/190.8 |
| 2008/0078351 | A1 * | 4/2008 | Thomas et al. | 123/190.8 |

FOREIGN PATENT DOCUMENTS

| | | | |
|---|---|---|---|
| WO | WO-01/92705 | A1 | 12/2001 |

* cited by examiner

INTERNAL COMBUSTION ENGINE WITH ROTARY VALVE

TECHNICAL FIELD

The present invention relates to improvements in axial flow rotary valve internal combustion engines to enable these engines to achieve fast combustion combined with high volumetric efficiency.

BACKGROUND

This invention is concerned with axial flow rotary valves that have both inlet port and exhaust port in the same valve. In particular it applies to rotary valves that have an outside diameter less than 85% of the cylinder bore diameter and to rotary valve engines where there is one valve per cylinder. An axial flow rotary valve is defined as one in which the axis of rotation of the valve is substantially perpendicular to the cylinder axis and the flow into and out of the valve is approximately parallel to the valve axis.

In multicylinder in-line engines using axial flow rotary valves with both inlet and exhaust ports in the same valve, there are two distinct types of axial flow rotary valves. The first type has one valve per cylinder and the second type has one valve for many cylinders.

The present invention applies to axial flow rotary valves which have one valve per cylinder. In general these multicylinder arrangements have the valve axis perpendicular to the crankshaft axis. However, this does not necessarily have to be the case. In some layouts there may be reasons for having the valve axis angled to a plane that is perpendicular to the crankshaft axis.

In the second type there is one valve for all cylinders in the bank and consequently the valve axis must be parallel to the crankshaft axis. This arrangement is basically flawed as the inlet and exhaust tract length is different for every cylinder. As a consequence the engine cannot use tuned inlet and exhaust tract lengths to optimise performance, a basic feature that is required on all modern engines.

The distinction between these two types applies only to multi cylinder in-line engines only, as on single cylinder engines there must be at least one valve per cylinder. Furthermore because there is no adjacent cylinder imposing geometric constraints on a single cylinder engine there are no constraints on the orientation of the valve axis relative to the crankshaft axis.

Axial flow rotary valve arrangements of both these types have been proposed for many years. Despite this none have been successfully commercialised. This is partly due to prior art arrangements which have poor breathing, poor combustion chamber shape, poor spark plug location and low turbulence.

The following elements are essential for a modern internal combustion engine to be competitive. Firstly, it must have adequate breathing capacity i.e. it must be able to achieve high volumetric efficiency at high speed. Secondly, it must have a combustion chamber shape and an ignition source or sources located within the combustion chamber such that the flame path to the extremities of the combustion chamber is minimised and the mass burn rate is maximised. Finally, it must be capable of generating suitable in-cylinder motion of the air fuel mixture during the intake stroke and breaking this down into small scale turbulence late in the compression stroke to maximise the speed at which the flame travels through the combustion chamber.

The arrangements required to optimise these three parameters in poppet valve engines have evolved over the last hundred years and today there is general consensus on how these parameters are optimised. The axial flow rotary valve introduces many physical constraints not found on the poppet valve, which means the solutions established for the poppet valve internal combustion engine are not readily transferable to the rotary valve.

In poppet valve technology the layout of the combustion chamber has evolved over many years to a point where there is general consensus as to what constitutes an optimum arrangement. It is universally accepted that a single spark plug mounted in the centre of the cylinder is the optimum arrangement. This arrangement is optimum as it minimises the length of the flame path to the extremities of the combustion chamber and it maximises the mass burn rate as the flame approaches the walls of the cylinder.

Engines with a single rotary valve per cylinder cannot position the spark plug in the centre of the cylinder without incurring other significant compromises in the layout of the engine. In this respect all axial flow rotary valves with one valve per cylinder have an inherent disadvantage when compared to poppet valve engines with a centrally located spark plug. In order for rotary valve engines to become commercially successful this inherent disadvantage must be addressed.

In particular, the present invention addresses a combustion chamber layout for an axial flow rotary valve where both inlet and exhaust ports are incorporated in the same valve and the valve diameter is typically less than 85% of the cylinder bore diameter.

Previous axial flow rotary valve arrangements generally fall into two categories. Firstly there are the valves that have an outside diameter equal to or larger than the cylinder bore diameter. These valves typically have a diameter 1.0 to 1.3 times the cylinder bore diameter. These arrangements do not have application in any multicylinder in-line arrangement using one valve per cylinder, as the bore spacing and hence engine length would be determined by the valve diameter and not the cylinder bore diameter. Thus any multicylinder arrangements using these valves would produce engines that are unnecessarily long and uncommercial. In general their application is limited to single cylinder engines. An example of such a proposal is shown in U.S. Pat. No. 4,404,934 (Asaka et al).

In single cylinder arrangements, the valve axis is invariably located near the centre of the cylinder. When the valve diameter is equal to or greater than the bore diameter there is no space to locate the spark plug beside the valve in a conventional location. The valve is generally located some distance from the top of the piston with the plug positioned under the valve—a typical example of such an arrangement is U.S. Pat. No. 3,948,227 (Guenther). These arrangements have very poor combustion chamber shape, and struggle to achieve a satisfactory compression ratio (particularly on engines with small cylinder swept volumes) due to the large distance between the piston and the valve.

The arrangement proposed in U.S. Pat. No. 3,948,227 (Guenther) at least has the advantage that the plug is located near the centre of the cylinder. Other arrangements such as U.S. Pat. No. 4,404,934 (Asaka et al) have the plug situated under the valve and close to the cylinder wall. The combination of the combustion chamber shape and the plug location will result in very slow combustion and poor thermal efficiency.

A multi cylinder in-line axial flow rotary valve arrangement of the second type previously described is shown in PCT publication number WO96/32569 (Ramsey), where the valve axis is parallel to the crankshaft. This arrangement has the benefit that the spark plugs are not located between the cylinders rather at the side of the cylinders. The plug placement is therefore no longer constrained by the adjacent cylinder and may be placed under the valve. PCT publication number WO96/32569 (Ramsey) states that one plug is the preferred layout but that two can be used. Despite the freedom to position the plug(s) without having to consider the adjacent cylinders the plug location is very poor, adjacent as it is to the cylinder wall and recessed from the body of the combustion chamber. The poor spark plug location in combination with the combustion chamber shape would result in very poor combustion in both single cylinder and multi cylinder engines. In the multicylinder arrangement it suffers the previously discussed problem of unequal inlet and exhaust tract lengths.

Secondly there are arrangements where the valves have a diameter smaller than the cylinder bore diameter. These arrangements have the advantage that they may be used on multicylinder in-line engines, with the valve axis perpendicular to the crankshaft axis, and the spark plugs may be inserted beside the rotary valve thus overcoming the limitations inherent in designs that require the spark plug to be located below the valve.

Typically in these arrangements the rotary valve is offset to the cylinder axis thus allowing the spark plug to be located near the cylinder centre. The valve offset can be arranged to get the spark plug sufficiently close to the centre of the cylinder to achieve acceptable combustion performance. A typical example is U.S. Pat. No. 4,852,532 (Bishop) or U.S. Pat. No. 5,526,780 (Wallis).

However there are many constructional aspects of engine design that are either compromised or complicated when offset valves are used. One such example is the location of the cylinder head bolts. These are optimally positioned from a structural, geometry and head gasket perspective at the midpoint between adjacent cylinders. This is often difficult to achieve with an offset valve.

One aspect of the present invention disclosed in this application involves the use of two spark plugs per cylinder. A two plug per cylinder arrangement is shown in U.S. Pat. No. 3,945,364 (Cook). This arrangement is however not an axial flow rotary valve as the gas flow is perpendicular to the valve axis. As with PCT publication number WO96/32569 (Ramsey), the valve axis is parallel to the crankshaft axis thus enabling the plugs to be located down the side of the engine without constraint from the adjacent cylinders. These valves arrangements overcome the problem of the valve disclosed in WO96/32569 as all cylinders may have equal length inlet and exhaust tracts. However they have been demonstrated to have problems during overlap with the inlet charge being short-circuited straight into the exhaust port and the cylinder not being adequately scavenged. This arrangement has a valve diameter approximately 30% greater than the cylinder bore diameter. As a consequence the spark plugs are located under the rotary valve adjacent the cylinder walls on opposite sides of the cylinder. While this is an improvement over a single plug located at the wall, it is still a very poor solution and one, when combined with the very poor combustion chamber shape would produce very slow burn rates and poor thermal efficiency.

Also, it is well known from extensive studies of poppet valve engines over many years that the presence of small scale turbulence in the charge gases during combustion dramatically increases the flame speed through the gases.

Turbulence is very important in all engines but particularly so in rotary valve engines, where the presence of small scale turbulence could potentially greatly increase combustion speeds and help ameliorate the effects of the inevitable non optimum spark plug locations found in rotary valve engines. There is no known prior art that addresses the issue of in-cylinder flows and the generation of small scale turbulence in rotary valve engines.

Several methods have been devised in conventional poppet valve engines to generate small scale turbulence late in the compression stroke. The three main existing methods of doing this are known as "swirl", "tumble" and "squish". In the case of swirl and tumble this is done by creating a bulk flow field in the cylinder during the intake stroke which decays to small scale turbulence during the compression stroke.

Tumble is defined as a flow vortex in the cylinder rotating about an axis perpendicular to the cylinder axis. In an engine designed for tumble a single major vortex is established during the inlet stroke. As the piston rises on the following compression stroke the vortex is compressed until it reaches a critical aspect ratio, where it breaks into smaller vortices. As the piston continues to rise these smaller vortices continue to break up over and over again until they become small scale turbulence.

Aspect ratio is defined as the width divided by the height of an object, except for when this is less than one, when the reciprocal (height divided by width) is used. When the piston is at bottom dead centre (bdc), the aspect ratio for oversquare engines is given by the bore divided by the stroke.

In another aspect, the present invention is concerned with methods for generating tumble in rotary valve engines. When considering tumble, two types of engine must be considered. Firstly, those with conventional bore stroke ratios of approximately 1:1 and secondly, those with high bore stroke ratios. There is no known prior art teaching on how to generate tumble in axial flow rotary valve engines with either conventional bore stroke ratio or high bore stroke ratio.

Most commercially available engines have bore stroke ratios around 1:1. In these engines the aspect ratio when the piston is at bottom dead centre is 1, which is conducive to the formation of a single major tumble vortex.

High speed engines however use oversquare engines (ie where the bore is greater than the stroke) in order to reduce the acceleration the piston and rods are subjected to at maximum engine speed. They are said to have high bore stroke ratios. For the purpose of this application an engine with a high bore stroke ratio is defined as one that has a bore stroke ratio greater than 1.4:1.

Engines using rotary valves of the type disclosed in this application potentially have very high breathing capacity, and are particularly well suited to use in high speed engines. However, the aspect ratio when the piston is at bottom dead centre is greater than 1.4 and this is not conducive to the formation of a single tumble vortex.

Squish is defined as a jet of gas acting along the piston crown shortly before top dead centre (tdc). As the piston travels towards tdc, the gas that is trapped in the areas where the piston crown and adjacent head surface come into close proximity is forced to flow at high velocity across the piston crown into regions where the piston and head are not in close proximity. Those areas where the piston crown and the adjacent head face come into close proximity to one another at tdc are known as squish zones.

In poppet valve engines squish is conventionally used as a method of generating small scale turbulence late in the compression stroke. Certain rotary valve prior art drawings shows areas of squish and the details and location of the squish suggest that it is designed to act in the same fashion that it is conventionally used on poppet valve engines. There are no known disclosures indicating the contrary.

As discussed above rotary valve engines require higher than normal levels of small scale turbulence than typically found in poppet valves. Absence of this higher level of turbulence will result in low flame speed and poor thermal efficiency. At best, the known prior art shows conventional use of squish which on its own will produce low levels of small scale turbulence.

The present invention seeks to overcome one or more of the disadvantages associated with the above mentioned prior art rotary valves.

SUMMARY OF INVENTION

The present invention consists of an axial flow rotary valve internal combustion engine comprising at least one rotary valve rotatable about an axis within a bore of a cylinder head, said valve communicating with a respective cylinder in which a piston reciprocates, and an ignition means associated with said cylinder, said rotary valve having an outside diameter less than 0.85 times the diameter of said cylinder, an inlet port extending from an inlet axial opening at one end of said valve and terminating as an inlet peripheral opening in the periphery of said valve, an exhaust port extending from an exhaust axial opening at the opposite end of said valve and terminating as an exhaust peripheral opening in the periphery of said valve, said peripheral openings periodically communicating with said cylinder through a window in said bore as said valve rotates, said window having a first window end proximate to said inlet axial opening and a second window end remote from said inlet axial opening, a combustion chamber formed in the space between the crown of said piston at top dead centre and said cylinder head and said valve, said head having a combustion surface surrounding said window and extending to the wall of said cylinder, characterised in that said window and said valve are substantially centrally disposed about a first plane within which the axis of said cylinder lies, said ignition means comprising first and second spark plugs, each of said spark plugs having a nose located at one end thereof exposed to said combustion chamber through said combustion surface, said noses being disposed on opposite sides of said window within the axial extremities of said window.

Preferably, the angle between the axis of each of said spark plugs and said first plane is less than 40 degrees and the intersection point of the axis of each said spark plugs with said combustion surface is radially inside the wall of said cylinder by a distance of at least 0.1 times the diameter of said cylinder.

Preferably, said at least one rotary valve comprises at least two rotary valves and the respective cylinders of said rotary valves are in-line.

Preferably, said combustion chamber has first and second squish zones, at least a portion of each of said first and second squish zones being between the wall of said cylinder and first and second spark plug noses respectively.

Preferably, each of said first and second squish zones extends circumferentially at least 35 degrees either side of a radial line between the axis of said cylinder and the centre of said first and second spark plugs noses respectively.

Preferably, said squish zones form a continuous circumferential squish zone, outside of said window, extending at least between a circle concentric with said cylinder and the wall of said cylinder, where the diameter of said circle is between the width of said window and twice the radial distance from the axis of said cylinder to the outside of the radially outermost of said spark plug noses.

Preferably, the intersection of said first window end with said combustion surface is closer to the axis of said cylinder than the intersection of said first window end with said bore thus forming a window lip.

Preferably, said window lip has a window lip profile generated by the intersection of said window lip with any plane parallel to said first plane, the angle between the tangent to said window lip profile and said axis being less than 70 degrees over at least 50% of the length of said window lip profile.

Preferably, said inlet peripheral opening has a first opening end proximate to said inlet axial opening, and said inlet port has a throat and a port floor extending from said first inlet end to said inlet axial opening, the distance between said port floor and said axis progressively increasing as said port floor extends away from said throat to said first inlet end, and the distance between said port floor and said axis progressively increasing as said port floor extends away from said throat to said inlet axial opening, the shape of said port floor between said throat and said first inlet end being adapted to direct air flowing adjacent said port floor through said inlet peripheral opening at an angle of less than 60 degrees to said axis.

Preferably, said inlet port has a throat and said inlet peripheral opening has a first opening end proximate to said inlet axial opening, the distance axially from said first opening end to said throat being at least 0.2 times the axial length of said inlet peripheral opening, said inlet port having a port floor extending from said first opening end to said inlet axial opening, the distance between said port floor and said axis progressively increasing as said port floor extends away from said throat to said first opening end, and the distance between said port floor and said axis progressively increasing as said port floor extends away from said throat to said inlet axial opening such that the cross sectional area of said throat is at least 2% less than the cross sectional area of said inlet axial opening, and a port floor profile generated by the intersection of said port floor with any second plane coincident with said axis intersecting said port floor, the angle between the tangent to said port floor profile and said axis being less than 60 degrees over at least 75% of the length of said port floor profile between said first opening end and said throat.

Preferably, the normal area of said inlet peripheral opening is at least 20% greater than the cross sectional area of said throat.

Preferably, the intersection of said first window end with said combustion surface is closer to the axis of said cylinder than the intersection of said first window end with said bore thus forming a window lip.

Preferably, said window lip has a window lip profile generated by the intersection of said window lip with any third plane parallel to said first plane, the angle between the tangent to said window lip profile and said axis being less than 70 degrees over at least 50% of the length of said window lip profile.

Preferably, said second plane is coincident with the centre of said inlet peripheral opening and said third plane is coincident with said first plane, and said port floor profile and said window lip profile have a substantially common tangent at a rotational position of said valve where said second plane is aligned with said first plane.

Preferably, the axial distance between the axial extremities of the intersections of said window ends with said bore is greater than 0.6 times the diameter of said cylinder.

Preferably, the intersection of said second window end with said bore is axially closer to the wall of said cylinder than the intersection of said first window end with said bore.

Preferably, said sides of said window are substantially parallel to the axis of said cylinder. Preferably, the width of said inlet peripheral opening is greater than the width of said window.

Preferably, said engine has a high bore stroke ratio.

BEST MODE OF CARRYING OUT THE INVENTION

Figure 1:
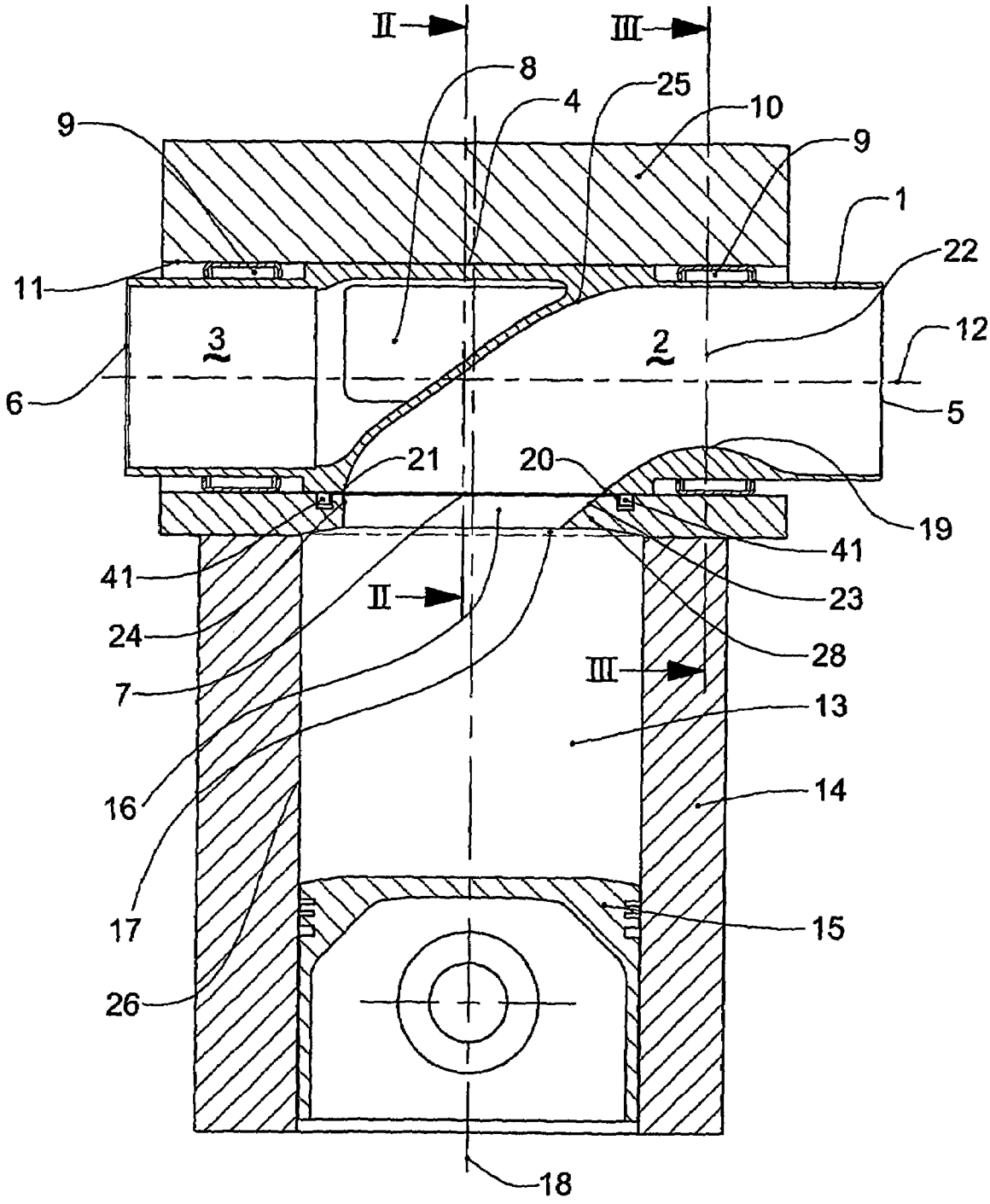
FIG. 1 is a cross-sectional view of an internal combustion engine with a conventional 1:1 bore stroke ratio with rotary valve in accordance with the present invention.

The rotary valve assembly shown in FIG. 1 comprises a valve 1 and a cylinder head 10. Valve 1 has an inlet port 2 and an exhaust port 3. Valve 1 has a cylindrical centre portion 4 of constant diameter. Inlet port 2 extends from inlet axial opening 5 and terminates at inlet peripheral opening 7 on the periphery of centre portion 4. Exhaust port 3 extends from exhaust axial opening 6 at the opposite end of valve 1 and terminates at exhaust peripheral opening 8 on the periphery of centre portion 4. Exhaust peripheral opening 8 axially overlaps inlet peripheral opening 7 and is circumferentially offset to inlet peripheral opening 7. Inlet peripheral opening 7 and exhaust peripheral opening 8 are approximately rectangular. Inlet peripheral opening 7 has a first end 20 proximate to inlet axial opening 5 and a second end 21 remote from inlet axial opening 5. Valve 1 is supported by bearings 9 to rotate about axis 12 in cylinder head 10. Axis 12 is perpendicular to cylinder axis 18. Bearings 9 allow valve 1 to rotate about axis 12 whilst maintaining a small running clearance between periphery of centre portion 4 and bore 11 of cylinder head 10.

Cylinder head 10 is mounted on the top of cylinder block 14. Piston 15 reciprocates in cylinder 13 formed in cylinder block 14. As valve 1 rotates, inlet peripheral opening 7 and exhaust peripheral opening 8 periodically communicate with window 16 in cylinder head 10, allowing the passage of fluids between combustion chamber 17 and valve 1.

Window 16 is approximately rectangular in shape and has a first window end 23 proximate to inlet axial opening 5, a second window end 24 remote from inlet axial opening 5. A window lip 28 is formed at first end 23.

An array of floating seals 41 surround window 16, to affect gas sealing between valve 1 and cylinder head 10. The seals 41 shown in FIG. 1 are circumferential seals located at opposite ends of window 16. However, the array also comprises axial seals (not shown in FIG. 1) substantially parallel to axis 12 and adjacent opposite sides of window 16. The array of floating seals 41, may for example be of the type disclosed in any of U.S. Pat. No. 4,852,532 (Bishop), U.S. Pat. No. 5,509,386 (Wallis et al) or U.S. Pat. No. 5,526,780 (Wallis).

Figure 2:
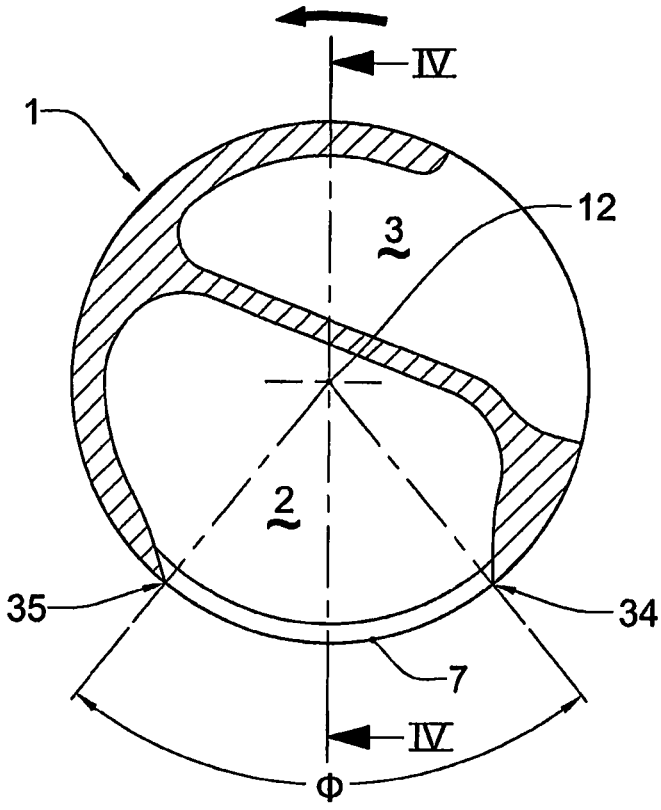
FIG. 2 is a cross-sectional view of the rotary valve depicted in FIG. 1 on a plane perpendicular to the axis of the rotary valve and passing through the midpoint of the axial extremities of the valve opening as indicated by line II-II.
Figure 3:
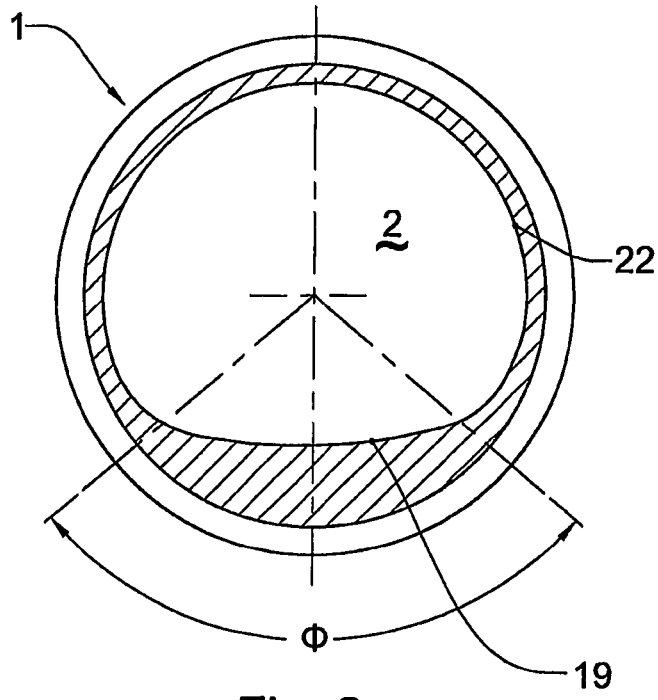
FIG. 3 is a cross-sectional view of the rotary valve depicted in FIG. 1 on a plane perpendicular to the axis of the rotary valve and passing through the throat as indicated by line III-III.

In FIG. 2, Φ is the angle subtended by lines passing through axis 12 and leading edge 34 and trailing edge 35 respectively of inlet peripheral opening 7, at an axial location midway between the axial extremities of inlet peripheral opening 7. FIG. 3 is a cross section through throat 22 of inlet port 2. Port floor 19 Is defined as the portion of the wall of inlet port 2 subtended by angle Φ where angle Φ is defined above.

Figure 4:
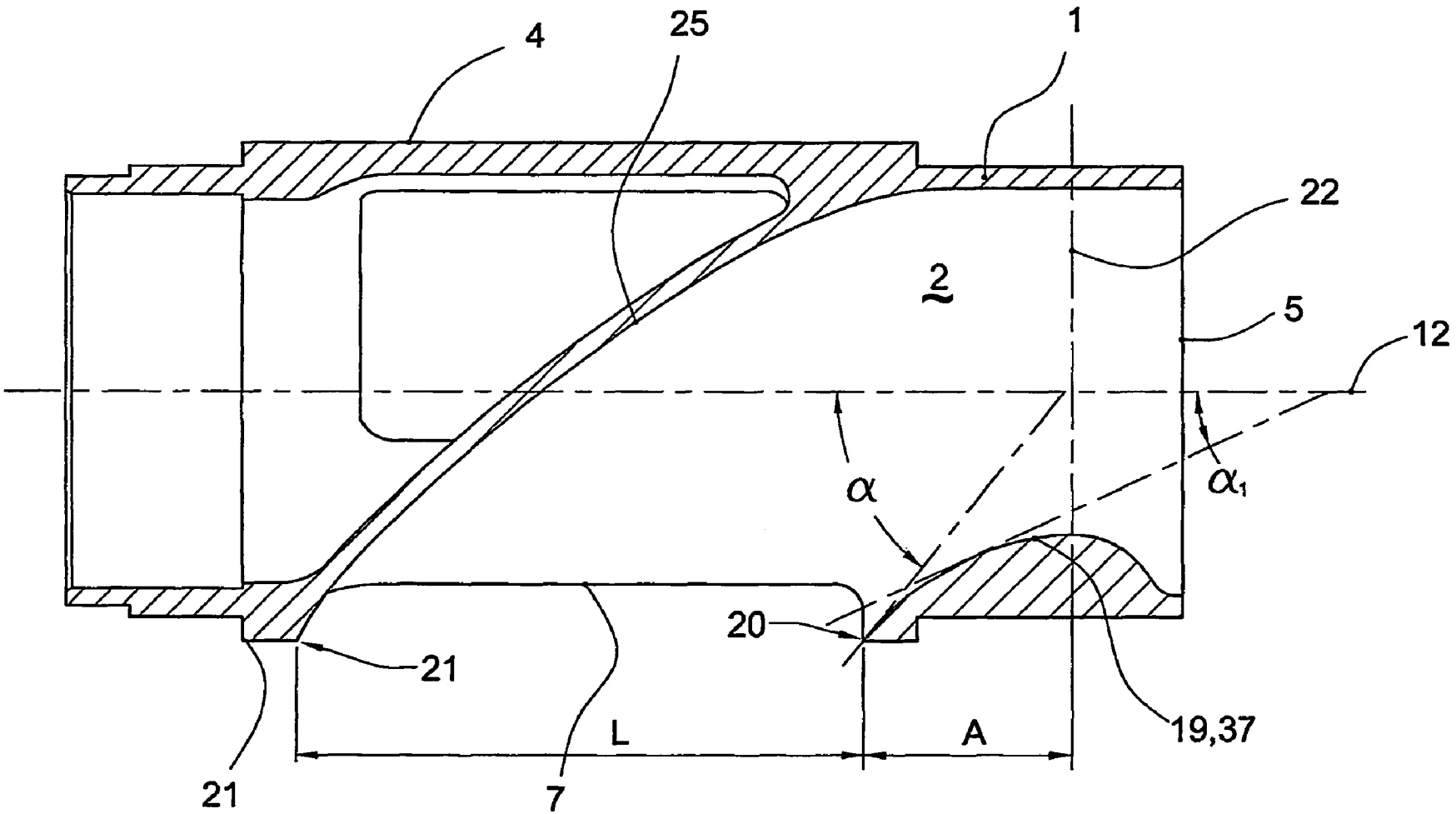
FIG. 4 is a cross-section view of the rotary valve of FIG. 2 through a plane coincident with the valve axis and centre of the inlet opening as indicated by line IV-IV.

FIG. 4 is a cross-section view of a rotary valve 1 through a plane coincident with axis 12 and the centre of inlet peripheral opening 7. Although peripheral opening 7 is described as substantially rectangular with edges 34, 35 being approximately parallel to axis 12, there are applications where it is beneficial to incline one or both of edges 34, 35 to axis 12 by a small amount, typically less than 10°. Similar issues arise with window 16. This creates issues with the definition of the centre of inlet peripheral opening 7 or the centre of window 16 that are addressed by defining their centre as follows:

The centre of inlet peripheral opening 7 is defined as the midpoint between edges 34 and 35 of inlet peripheral opening 7 at an axial location midway between the axial extremities of inlet peripheral opening 7. The centre of window 16 is defined as the midpoint between the sides of window 16 at an axial location midway between the axial extremities of window 16.

Throat 22 of inlet port 2 is defined as the section normal to axis 12 and lying between first end 20 and inlet axial opening 5 where the smallest cross-sectional port area occurs. In the event the smallest cross-sectional port area occurs at more than one section normal to axis 12 throat 22 is defined as that section axially closest to first end 20. In this application all cross-sectional port areas are measured in a plane normal to axis 12.

Throat 22 of inlet port 2 is located an axial distance A from first end 20 of inlet peripheral opening 7 where A is greater than 0.2 times the axial length L of inlet peripheral opening 7. The axial length L of inlet peripheral opening 7 is defined as the axial length between the axial extremities of inlet peripheral opening 7.

For the purposes of this application the shape of the surface that forms inlet port floor 19 is limited to a description of the two-dimensional profiles generated by the intersection of port floor 19 by planes coincident with axis 12. FIG. 4 shows a typical example of such a port floor profile 37. Port floor profile 37 is defined as the two dimensional profile generated by the intersection of port floor 19 by a plane coincident with valve axis 12.

Upstream of throat 22 the radial distance between port floor 19 and axis 12 progressively increases as port floor 19 extends away from throat 22 towards axial opening 5. Downstream of throat 22, the radial distance between port floor 19 and axis 12 progressively increases as port floor 19 extends away from throat 22 towards first end 20. As a result, the cross sectional area of throat 22 is smaller than the cross sectional area of the substantially circular inlet axial opening 5. Preferably the cross sectional area of throat 22 is at least 2% less than the cross sectional area of inlet opening 5.

At the throat the tangent to port floor 19 is typically parallel to axis 12. At first end 20 of inlet peripheral opening 7 the tangent to port floor profile 37 intersects axis 12 at an angle $\alpha$. Axially outward of first end 20 the tangent to port floor profile 37 intersects axis 12 at a varying angle $\alpha_1$. In this embodiment, in the region between first end 20 and throat 22 $\alpha_1$ is always less than 60°. For the purposes of this application tangent angle is defined as the angle at which the tangent to port floor profile 37 intersects axis 12

As a result of the underlying valve geometry the size of the tangent angle $\alpha$ will vary depending on the angular orientation of the intersecting plane. However the largest tangent angles $\alpha$ for any particular valve will typically occur when the intersecting plane passes through the centre of inlet peripheral opening 7.

The shape of port floor 19 thus effectively has a large radius about which the flow adjacent to port floor 19 can be turned without danger of the flow becoming separated from port floor 19. After being turned, the flow adjacent port floor 19 is then directed through inlet peripheral opening 7 at angle $\alpha$ to axis 12 into window 16. An important feature of port floor 19 is that it only turns the incoming flow adjacent port floor 19 through the angle $\alpha$ (refer to FIG. 4) where $\alpha$ is less than 60° and typically may be as low as 30°. As a consequence, separation of flow from port floor 19 is avoided.

Figure 5:
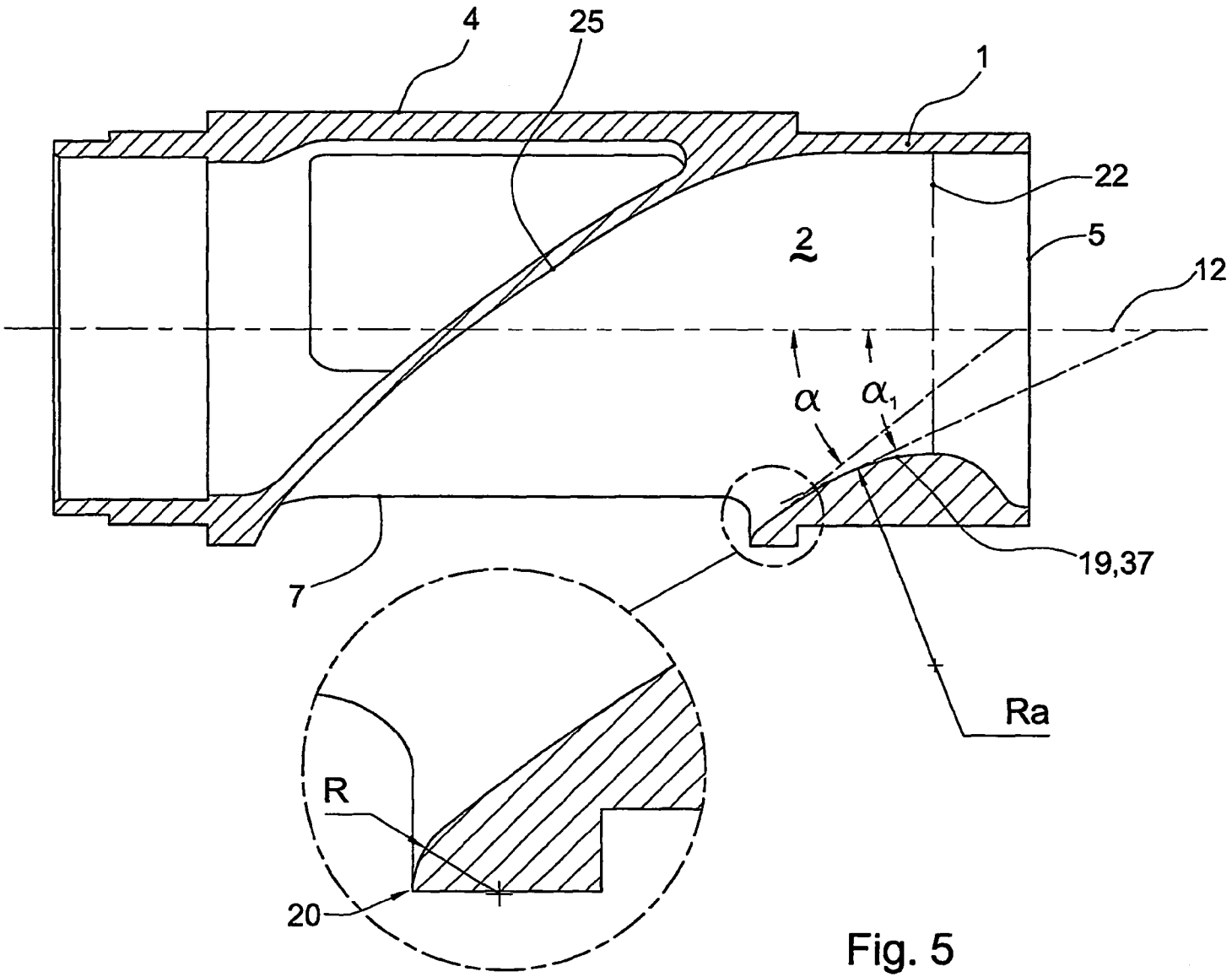
FIG. 5 shows an alternative embodiment of a rotary valve in accordance with the present invention viewed in the same manner as FIG. 4.

Port floor 19 of the alternative embodiment shown in FIG. 5, Is different in its detail adjacent first end 20. The small radius R adjacent first end 20 will have little effect on the performance of port floor 19, and as such flow adjacent port floor 19 will still be directed through inlet opening 7 at an angle $\alpha$ of less than 60°. Similarly, the performance of port floor 19 is not affected in the event the small radius R adjacent first end 20 is replaced by a small chamfer.

The functional requirement of the port floor is achieved if the greater portion of port floor 19 surfaces, between throat 22 and first end 20, have small tangent angles. Small portions of port floor 19 where the tangent angle is large will have little effect on the direction of the flow adjacent port floor 19 when the rest of port floor 19 has small tangent angles. This particularly applies to any rapid changes in port floor shape immediately adjacent first end 20 that may be required to blend inlet peripheral opening 7 to port floor 19, such as radius R in FIG. 5, since this localised rapid shape change is not capable of substantially changing the direction of flow through inlet peripheral opening 7. As a consequence port floor profiles 37 are constrained to certain tangent angles over a proportion of the length of port floor profile 37 only. Preferably port floor profile 37 between throat 22 and first end 20 should have tangent angles less than 60 degrees over at least 75% of the length of port floor profile 37.

In FIG. 1 the surface of window lip 28 is approximately tangent to port floor 19 at intersection of port floor 19 with first end 20 of inlet peripheral opening 7. Window lip 28 provides a surface to which the flow may remain attached as it passes through window 16. By this means the flow adjacent port floor 19 remains attached to a surface until the point it finally enters cylinder 13. Window lip 28 results in a re-entrant zone in combustion chamber 17 which would normally be avoided in combustion camber design. This zone has however been demonstrated not to adversely affect combustion.

Figure 6:
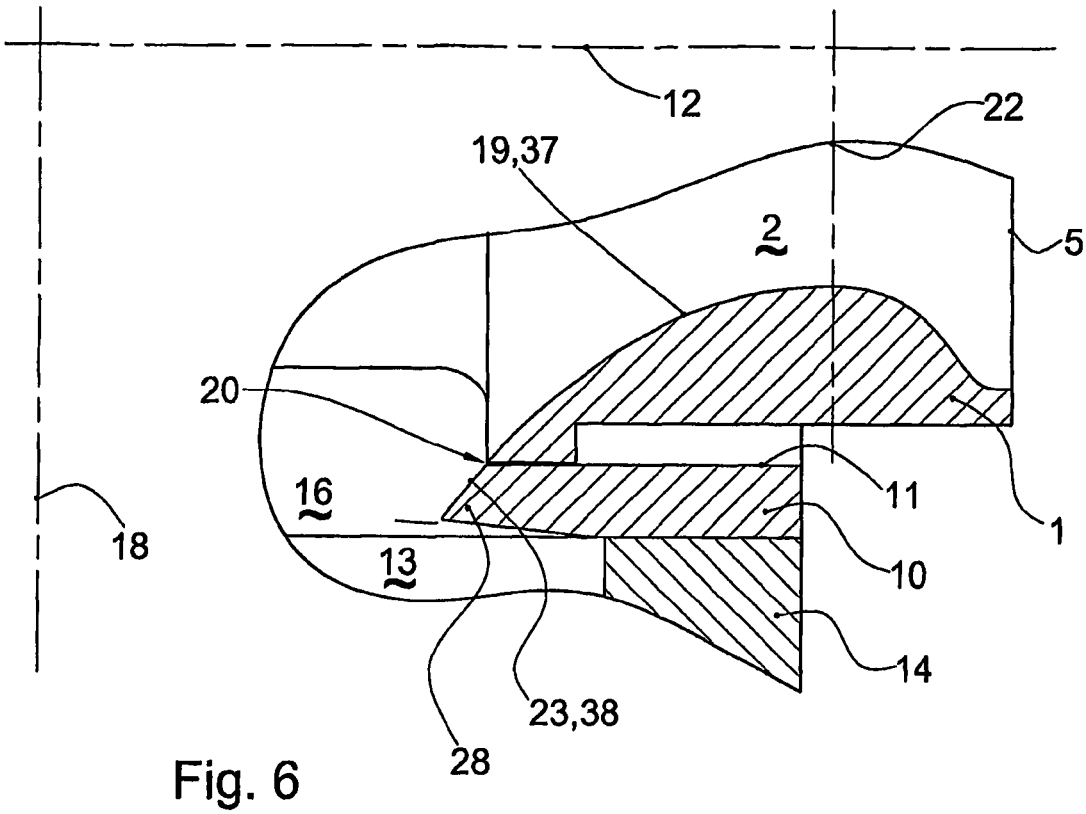
FIG. 6 is an enlarged partial cross-sectional view of the valve port floor and the cylinder head window lip of the engine of FIG. 1.
Figure 7:
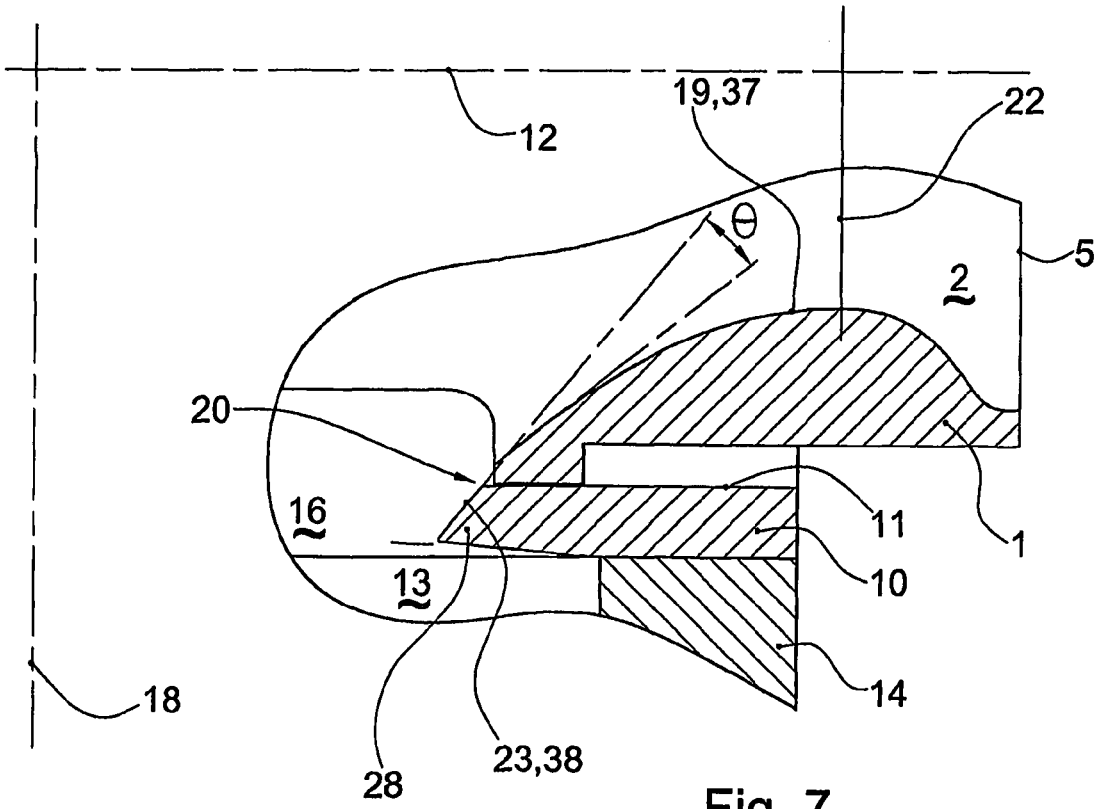
FIG. 7 shows the details of the window lip of an alternative embodiment of a rotary valve engine in accordance with the present invention viewed in the same manner as FIG. 6.

When specifying window lip surface geometry similar issues to those previously discussed in relation to port floor surface geometry arise. For the purpose of describing window lip surface geometry it is sufficient to describe window lip profile 38 where this profile is generated by the intersection of a plane, parallel to a first plane that is coincident with axis 12 and the centre of window 16, with lip 28. Typical window lip profiles 38 are shown in FIGS. 6 and 7. Preferably the angle between axis 12 and the tangent to window lip profile 38 is less than 70 degrees over at least 50% of the length of window lip profile 38.

In FIG. 6 the tangent to port floor profile 37 at first end 20 and the tangent to window lip profile 38 at the point of its intersection with bore 11 are equal.

FIG. 7 is the same view as FIG. 6 but with a different valve 1 detail at first end 20. It is often undesirable to have a feather edge on first end 20 of inlet peripheral opening 7. This is overcome by leaving a small step at first end 20 and offsetting first end 20 from first window end 23 as shown in FIG. 7. The tangent to port floor profile 37 at first end 20 and the tangent to window lip profile 38 at the point of its intersection with bore 11 are different by $\theta$ degrees. A difference of up to 20° is acceptable.

The different valve detail at first end 20 in FIG. 7 creates a small radially outwardly extending step that finishes at the periphery of centre section 4. This step forms part of port floor profile 37 and the radial depth of this step forms part of the length of port floor profile 37. Similar considerations apply to window lip profile 38.

Figure 8:
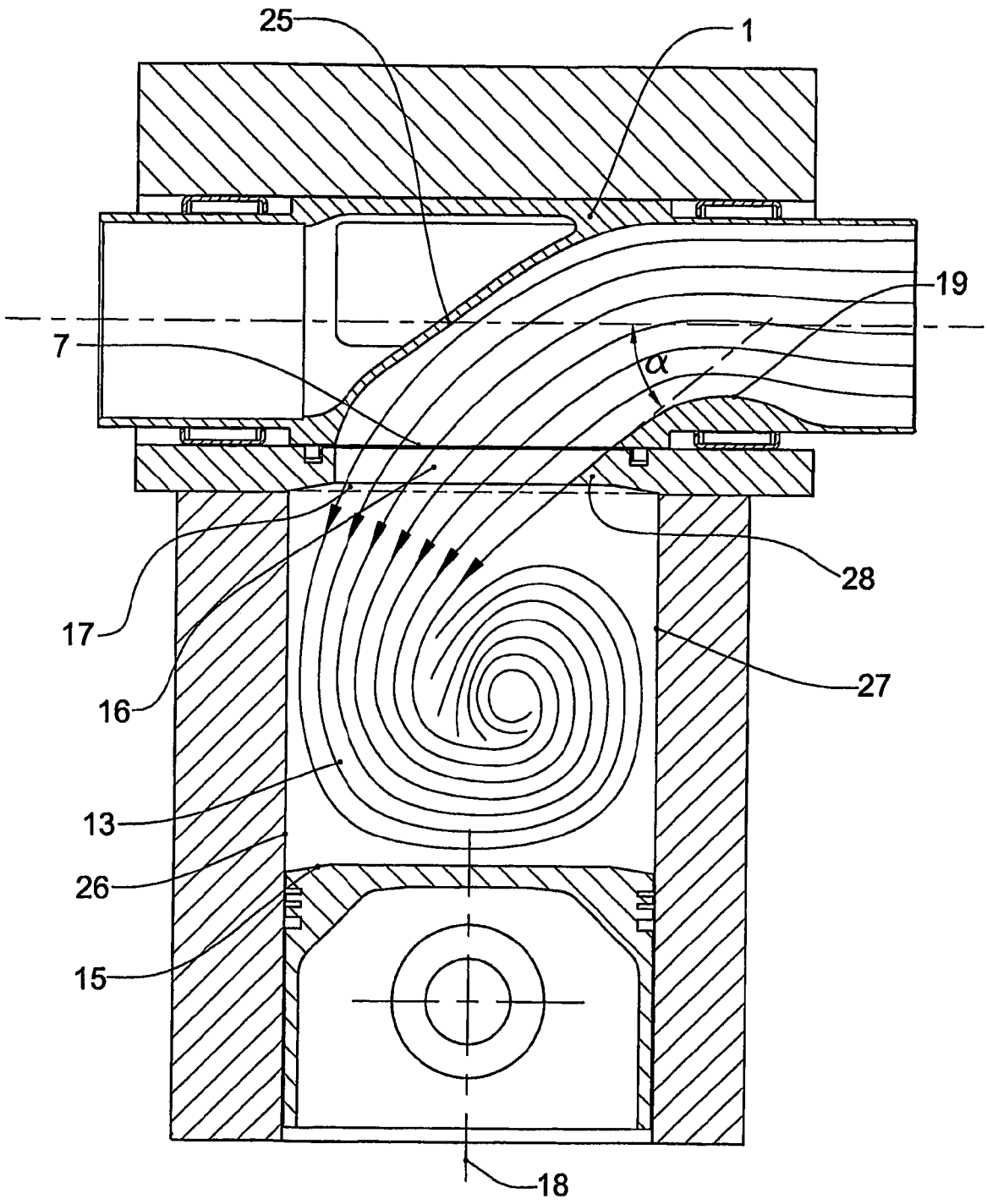
FIG. 8 is the same cross-sectional view as FIG. 1 but showing a schematic of the flow streamlines in the valve and the cylinder with the piston at bottom dead centre.

Referring to FIG. 8, the port roof 25 provides a surface that turns the air adjacent to this surface through nearly 90°. Port roof 25 has at least one large diameter radius about which the flow is turned. This large radius combined with the fact the flow is impinging onto the wall of port roof 25 ensures the flow near port roof 25 is turned through an angle approaching 90° with very small flow losses. Flow adjacent port roof 25 is thus turned through an angle approaching 90° and flows through window 16 substantially normal to window 16.

Flow adjacent port floor 19 is turned through a of less than 60° and flows through window 16 at an angle of $(90-\alpha)°$ to cylinder axis 18. Those flows occurring between port floor 19 and port roof 25 are turned through various angles between 90° and $\alpha°$ and pass through inlet peripheral opening 7 at angles varying between 0° and $(90-\alpha)°$ to cylinder axis 18. The potential difficulty with this approach is that the area of inlet peripheral opening 7 is not efficiently used. Flow through inlet peripheral opening 7 is maximised when the flow is normal to inlet peripheral opening 7. This particular problem is addressed by making the normal area of inlet peripheral opening 7 substantially greater than the cross sectional area of throat 22. As a consequence the loss of flow efficiency through inlet peripheral opening 7 is compensated by having a larger inlet peripheral opening 7 area than would otherwise be necessary. Typically inlet peripheral opening 7 may have a normal area 50% greater than the cross sectional area of throat 22.

The normal area of inlet peripheral opening 7 is the area contained between ends 20, 21 and edges 34, 35 of inlet peripheral opening 7 projected onto a plane normal to another plane that is coincident with axis 12 and the centre of inlet peripheral opening 7.

FIG. 8 shows flow streamlines for an engine with a conventional bore stroke ratio of 1:1 and with piston 15 at bottom dead centre of the inlet stroke. The flow stream lines indicate the path of particular gas particles through cylinder 13 and schematically illustrate the strong tumble gas motion generated in such an arrangement.

During the induction stroke the flow occurring adjacent port roof 25 passes through inlet peripheral opening 7 approximately normal to inlet peripheral opening 7 and flows down adjacent cylinder wall 26. Flow occurring adjacent port floor 19 passes through inlet peripheral opening 7 at $\alpha°$ to inlet peripheral opening 7, then passes through window 16 attached to window lip 28 into combustion chamber 17 where it flows towards far cylinder wall 26 where it converges with the flow from port roof 25. As port floor 19 flow approaches cylinder wall 26, down which the port roof flow is flowing, the port floor flow is turned through $(90-\alpha)°$ and flows down the bore of cylinder 13 close to cylinder wall 26.

By this process the inlet air is forced against cylinder wall 26 remote from inlet axial opening 5 creating ideal conditions for the formation of tumble flow. The downward air flow concentrated against one side of cylinder 13 hits the crown of piston 15 which turns the air through 180 deg after which it travels up opposite cylinder wall 27 where it becomes entrained by the inlet air from valve 1 and is turned again to flow down cylinder wall 26.

Axial flow rotary valves using this principle have excellent breathing capacity together with extremely high tumble. Rotary valves of this type generate high tumble flows irrespective of the location of the valve relative to the centre of cylinder 13 provided that the engine has a bore stroke ratio of approximately 1:1. Consequently, valve 1 can be offset to cylinder axis 18 in order to provide an appropriate location for the spark plug near the centre of cylinder 13 without adversely affecting the generation of tumble flow. Engines of this type have outstanding combustion even in the event the spark plugs are somewhat offset from the cylinder centre.

Whilst this solution satisfactorily addresses the issue of tumble generation on rotary valve engines with conventional bore stroke ratios it does not address the issue on engines with high bore stroke ratios that have an unfavourable (from a tumble perspective) aspect ratio when the engine is at bottom dead centre. Further this solution relies on an offset valve arrangement that introduces other difficulties in the construction of multicylinder in-line engines.

Figure 10:
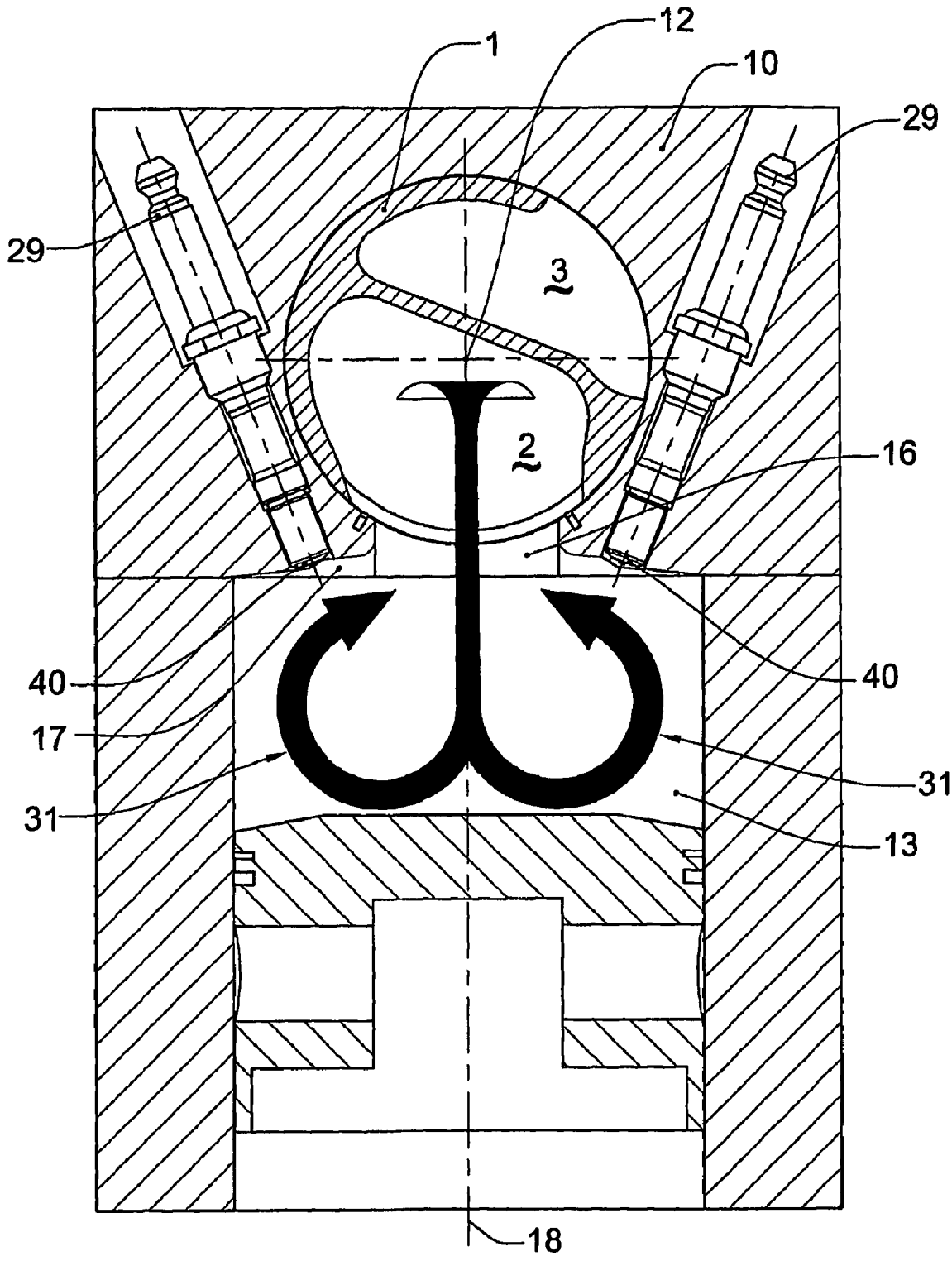
FIG. 10 is a transverse cross-sectional view through X-X of the same internal combustion engine shown in FIG. 9 schematically showing the dual cross tumble flow.

FIG. 10 shows an internal combustion engine with a high bore stroke ratio (2:1) typical of that found on many high speed engines. Axis 12 intersects cylinder axis 18. Spark plugs 29 each have a nose 40 which faces combustion chamber 17. Nose 40 is defined as that portion of spark plug 29 that is exposed to combustion chamber 17. Spark plugs 29 are located either side of valve 1 and are inclined inward towards cylinder axis 18. Valve 1 has a small outside diameter which allows spark plugs 29 to be inserted beside valve 1 whilst still each having spark plug nose 40 located inboard of the wall of cylinder 13.

Figure 11:
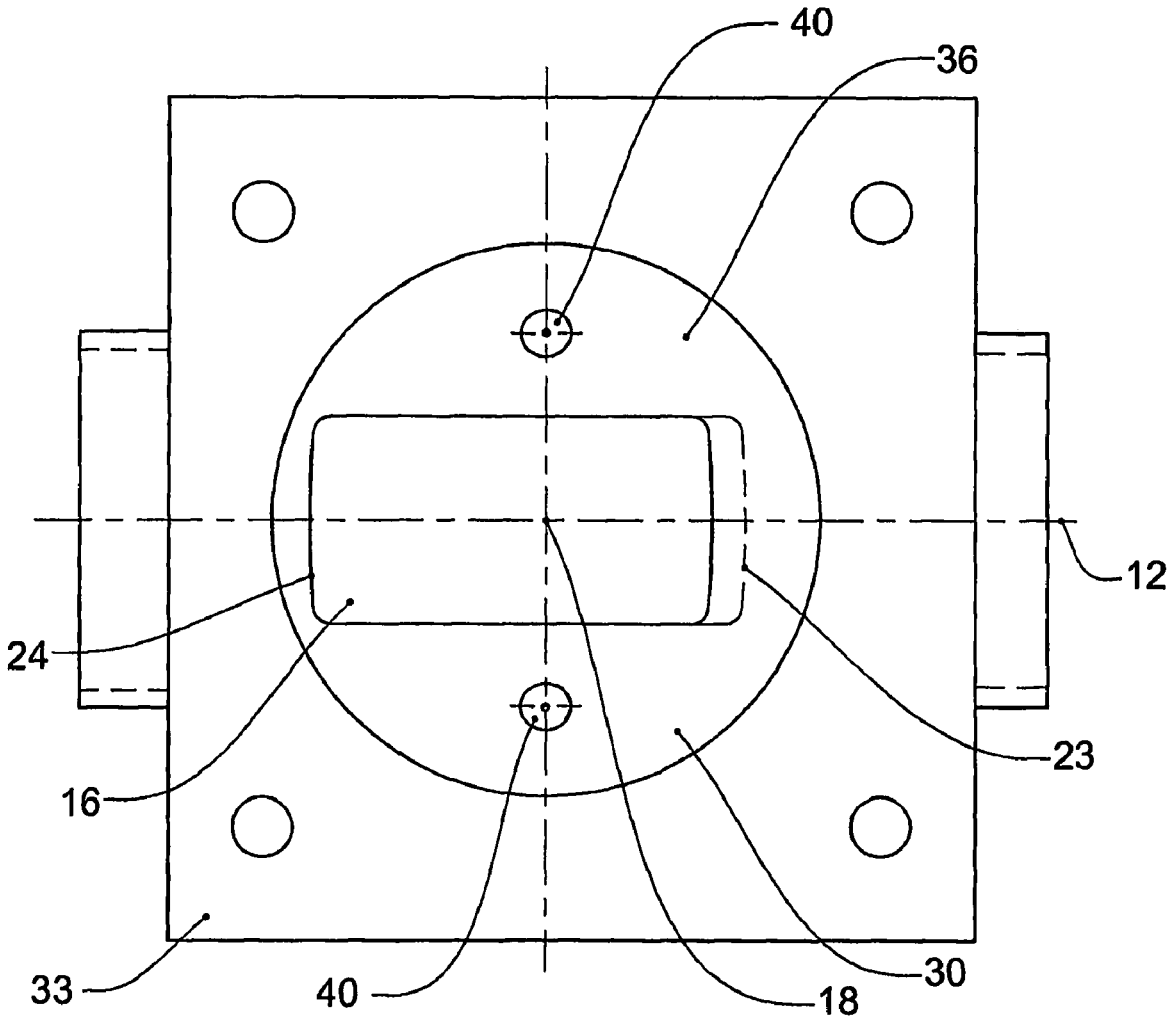
FIG. 11 is a view looking onto the fire face of the cylinder head assembly of the engine shown in FIGS. 9 and 10.

FIG. 11 is a view looking onto fireface 33 of cylinder head 10. Window 16 is offset axially along rotary valve axis 12 from cylinder axis 18. Second window end 24 at its point of intersection with bore 11 is closer to the wall of cylinder 13 than first window end 23 at its point of intersection with bore 11. This window offset aids the generation of tumble flows as described above. Window 16 as it intersect cylinder head bore 11 is approximately rectangular with its long sides substantially parallel to axis 12. Window 16 as it intersects bore 11 typically has a length between 60% and 90% of the cylinder bore diameter. The sides of window 16 are approximately parallel to cylinder axis 18. Spark plug noses 40 are located either side of window 16. That portion of combustion chamber 17 outside window 16 is a squish zone 30. The surface of cylinder head 10 surrounding window 16 and extending to the walls of cylinder 13 is defined as combustion surface 36.

Figure 9:
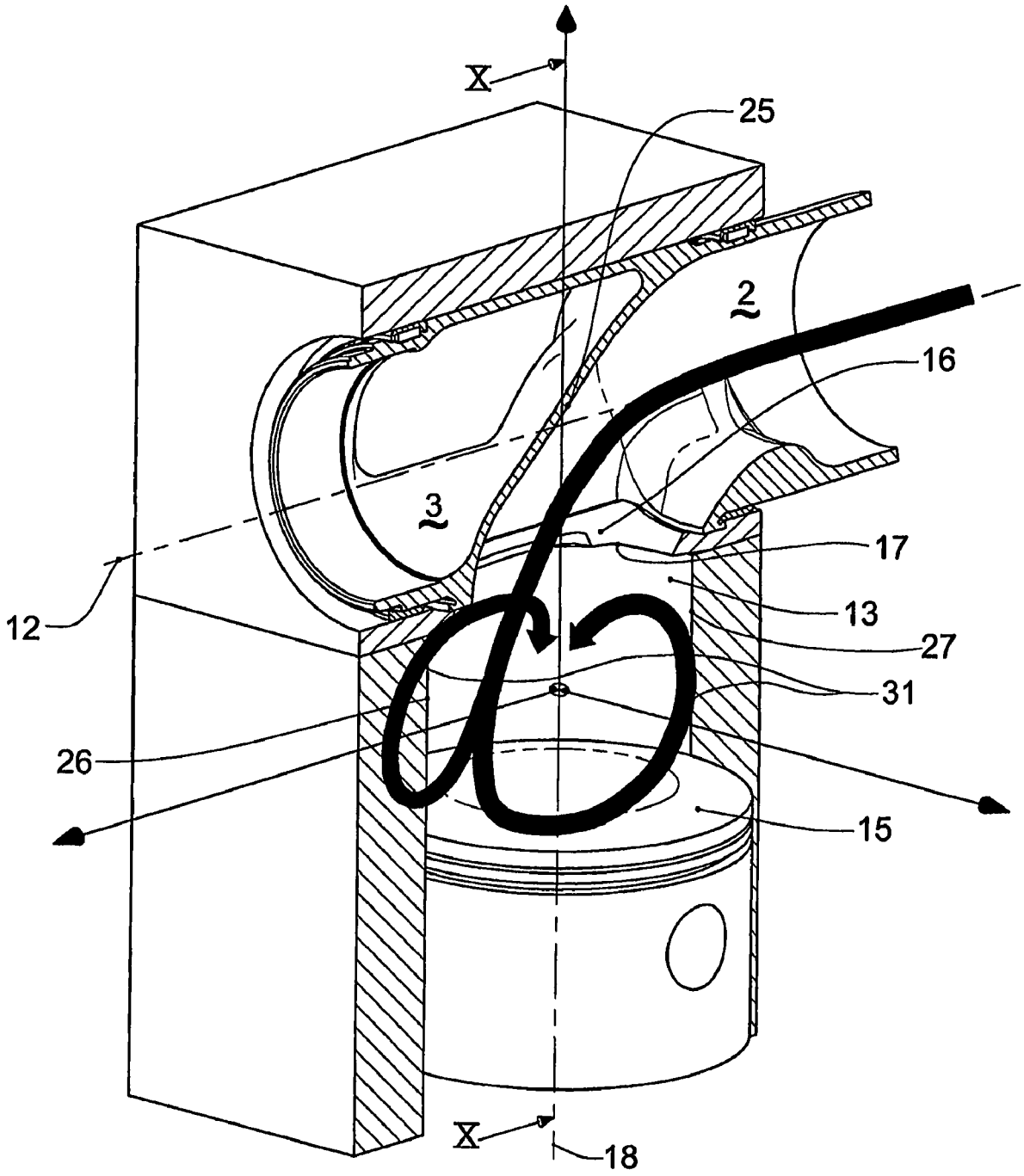
FIG. 9 is an isometric sectional view through an alternative embodiment of a rotary valve internal combustion engine in accordance with the present invention having a high bore stroke ratio and schematically showing the dual cross flow tumble regime generated during the induction stroke with the piston at bottom dead centre.

In rotary valve arrangements with high bore stroke ratios, the incoming air stream is prevented from forming a strong tumble vortex of the type previous described by the unfavourable geometry of cylinder 13 when piston 15 is at bottom dead centre. Referring to FIG. 9 the incoming air stream enters cylinder 13 as previously described. It travels towards the crown of piston 15 as a gas jet in cylinder 13. Unable to roll back under itself as previously described, the gas jet impinges on surfaces formed by the crown of piston 15 and cylinder wall 26 where the jet flow splits into two. After splitting the jet curves back on itself and runs around the wall of cylinder 13 towards combustion chamber 17 in the process forming two approximately symmetrical vortices. The vortices shown in FIG. 9 are inclined to cylinder axis 18. As this flow is three dimensional the projection of this flow onto a plane perpendicular to axis 12 will produce two counter rotating vortices 31 as shown in FIG. 10. These counter rotating vortices form a "dual cross tumble" vortex. The tumble is referred to as "cross tumble", as the plane of the tumble is perpendicular to that previously described in engines of conventional bore stroke ratio.

The aspect ratio of these vortices at bdc is given by the cylinder radius (cylinder bore/2) divided by the stroke. In the case of an engine with a bore stroke ratio of 2:1 the aspect ratio of these vortices at bdc is 1, the optimum ratio for tumble generation.

The strongest dual tumble vortices will be generated when both vortices are symmetrical and of equal magnitude. If the vortices have significantly different magnitudes the stronger one tends to destroy the weaker one. Symmetrical vortices are generated by centring window 16 on cylinder axis 18.

The strongest dual flow cross tumbles are also generated when the gas jet emerging from window 16 into cylinder 13 is as narrow as possible and directed such that the jet flow is symmetrical about cylinder axis 18. This is achieved by making window 16 as narrow as possible and the side faces of window 16 flat and parallel to cylinder axis 18.

The width of window 16 and inlet peripheral opening 7 are determined by the required duration of the inlet valve open. This duration is a function of the combined widths of both inlet peripheral opening 7 and window 16. Traditionally these widths are made equal to maximise the flow area through the inlet peripheral opening 7 and window 16 when the inlet valve is fully open. On arrangements according to this invention window 16 width is minimised to maximise tumble generation. This requires a corresponding increase in width of inlet peripheral opening 7. Consequently the width of window 16 is typically smaller than the width of inlet peripheral opening 7

It should be noted that an arrangement as described above for the high bore stroke ratio engine will work equally as well on a conventional bore stroke ratio engine, where instead of a dual flow tumble field being generated a normal tumble flow field will be generated.

The requirement to place axis 12 close to cylinder axis 18 introduces other constraints that have not previously been explored on axial flow rotary valves where the valve diameter is smaller than the cylinder bore diameter. Valve 1 can no longer be offset to cylinder axis 18 to allow spark plug 29 to be positioned near cylinder axis 18.

FIG. 11 shows two spark plug noses 40 located in a squish zone 30 outside window 16. Spark plug noses 40 are closer to the cylinder wall than they are to the centre of cylinder 13, an arrangement that conventional logic would dismiss as unacceptable from a combustion stand point. Another unusual aspect of the placement of spark plugs 29 is that spark plugs noses 40 are located in the centre of a squish zone 30. In most conventional engines, spark plugs noses 40 are located well away from the squish zone. For example in conventional four valve poppet valve engine the spark plug is located in the centre of the combustion chamber, and the squish zones are located adjacent the cylinder walls.

This particular arrangement of two spark plugs noses 40 located within squish zone 30 has been demonstrated to work very much like that of a centrally located spark plug. The air fuel mixture is ignited by spark plugs 29 on both sides of window 16. Shortly afterwards the gas jet generated by squish zone 30 pushes the flame front into the centre of window 16. As there are two spark plugs 29 the flame fronts from both sides of window 16 are forced into window 16 near cylinder axis 18 where they combine into a single large flame front. Thereafter, the flame front spreads out across combustion chamber 17 as if it was ignited from a single central spark plug. The small scale turbulence generated by either the tumble flow in the case of conventional bore stroke ratios or the dual tumble in the case of the high bore stroke ratio engine ensures that the flame speed is very fast. The combination of a central flame front and fast flame speed means the combustion rate is very fast with corresponding high thermal efficiency.

The location of spark plug noses 40 should be as close to the centre of the cylinder as possible within the geometric constraints set by a central valve and the rotary valve assembly of the adjacent cylinder. Spark plug noses 40 are wholly radially located between window 16 and the wall of cylinder 13 and axially within the length of window 16. The centre of spark plug noses 40 are preferably located radially inboard of the wall of cylinder 13 by a distance greater than 0.1 times the diameter of cylinder 13.

Figure 12:
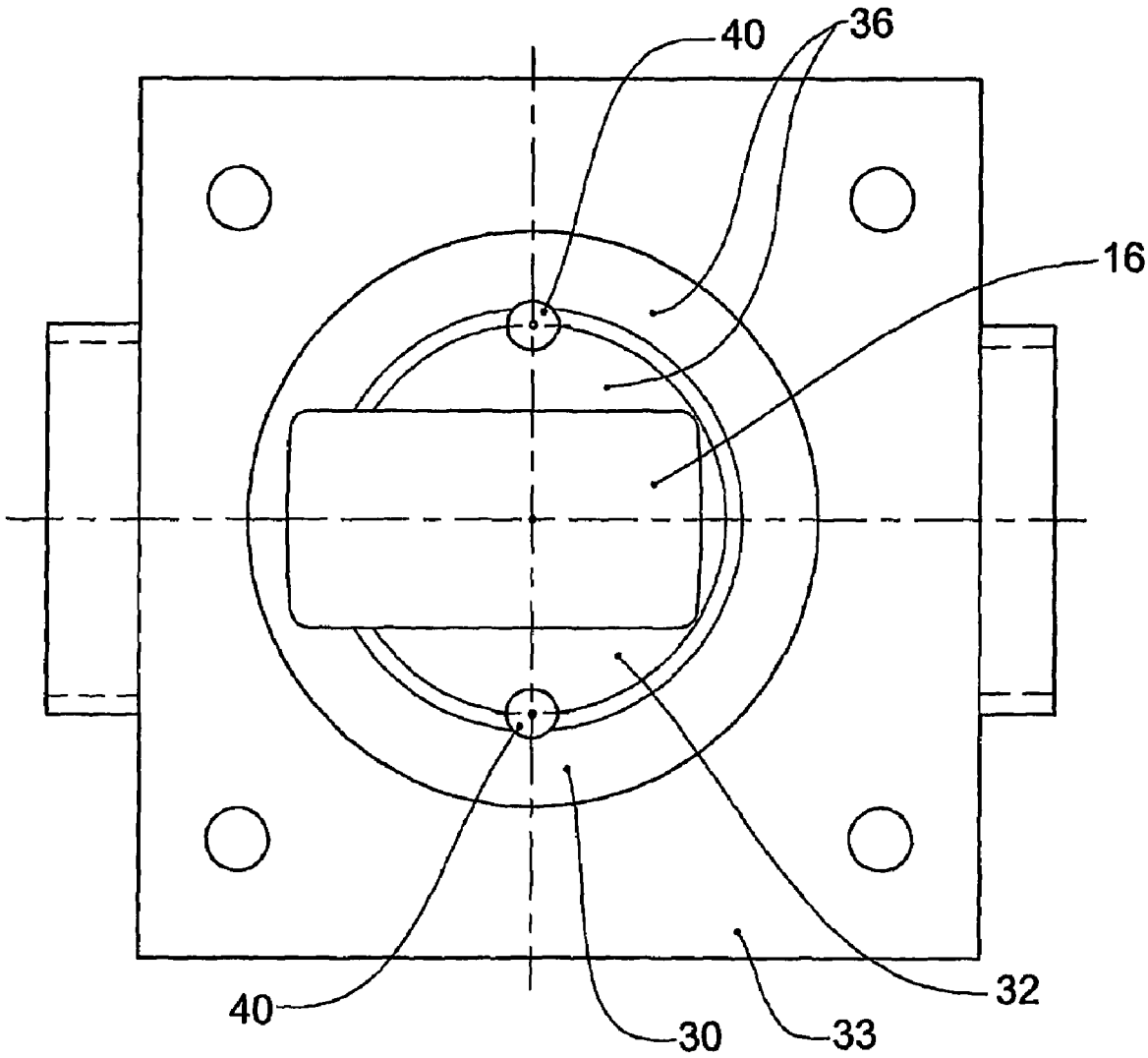
FIG. 12 is the same view as FIG. 11 but with alternate embodiment of the squish zone.
Figure 13:
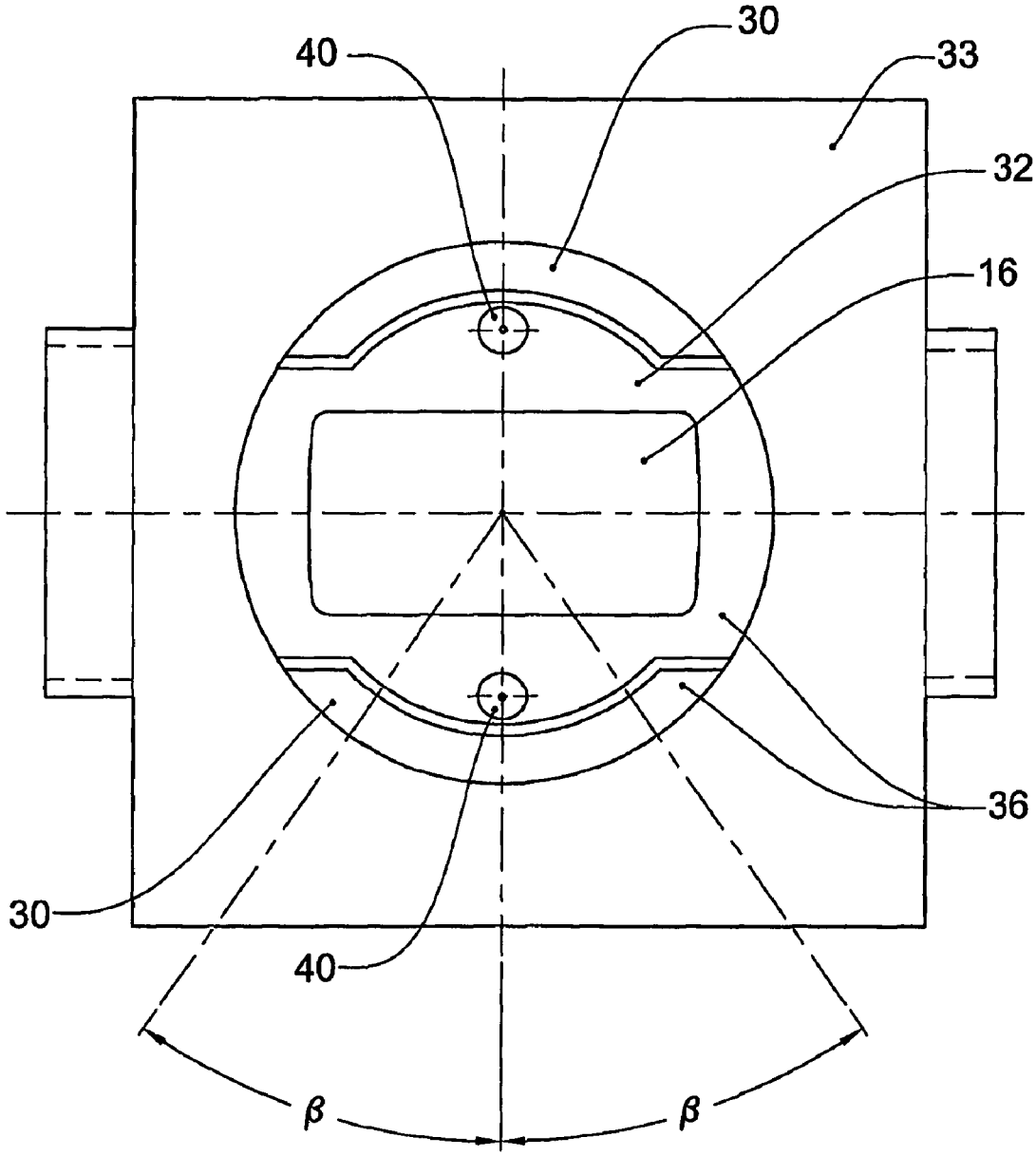
FIG. 13 is the same view as FIG. 11 with another alternate embodiment of the squish zone.

FIGS. 12 and 13 show alternate arrangements of squish zone 30 that will achieve a similar outcome to that described above. In FIG. 12 the radial extending squish zone 30 terminates adjacent spark plug nose 40 leaving an area without squish referred to as non-squish zone 32. Squish zone 30 immediately radially outboard of spark plug nose 40 is sufficient to push the flame front into window 16.

A similar situation exists in FIG. 13 where squish zone 30 occurs in a zone outboard of spark plug nose 40. However a radially disposed symmetric squish zone as shown in FIGS. 11 and 12 is preferred as the radial inflow of the cylinder gases helps to direct the flame front to the centre of the cylinder with minimum dispersion.

The minimum acceptable squish zone 30 is defined as a squish zone that extends radially inward from the wall of cylinder 13 towards spark plug nose 40 and circumferentially through an arc β both sides of a radial line through the centre of spark plug nose 40 where β is greater than 35°. However, it is acceptable for a small local relief in the squish zone to be placed in the area immediately surrounding spark plug nose 40.

Figure 14:
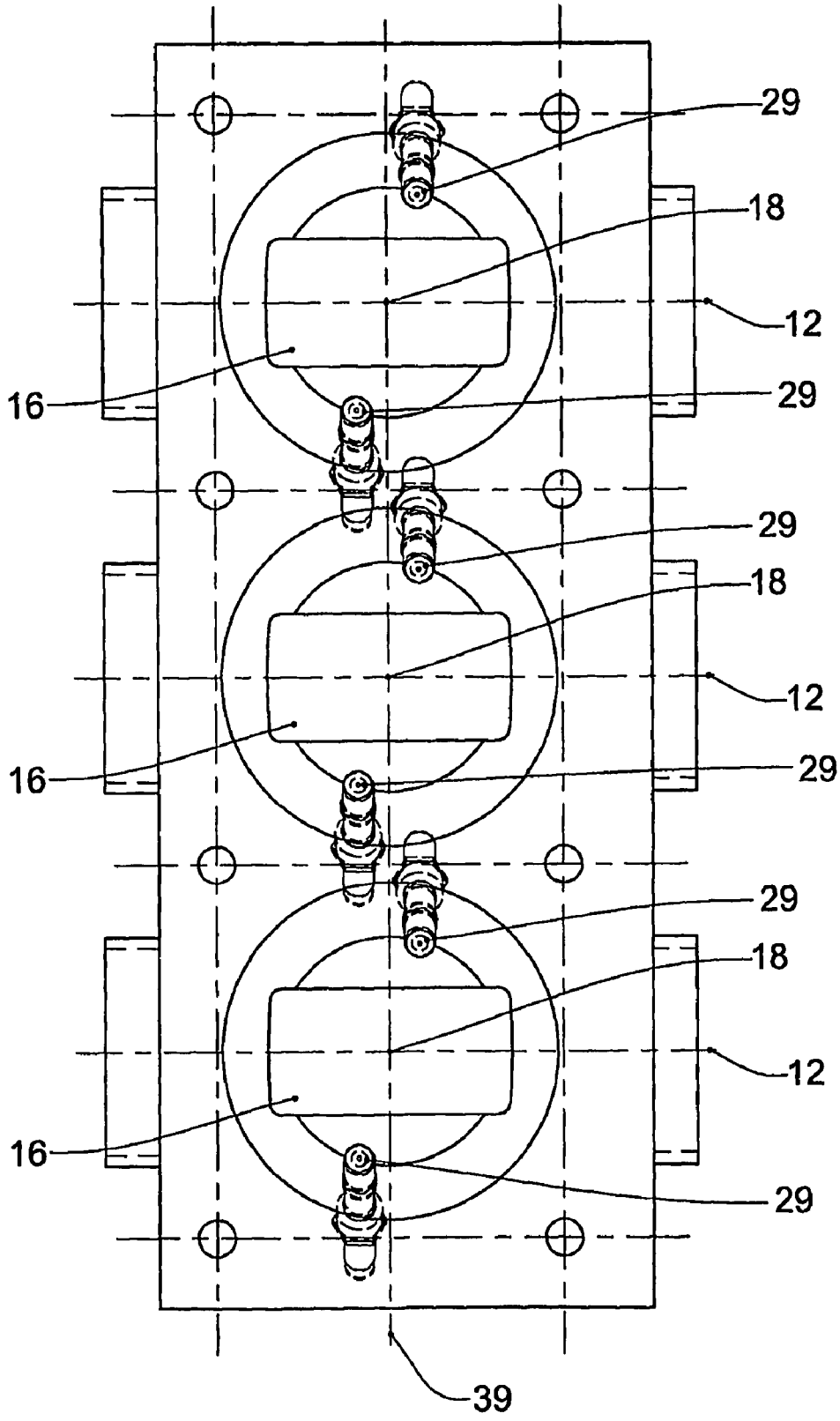
FIG. 14 is a view looking onto the fire face of a multicylinder rotary valve cylinder head assembly in accordance with the present invention

FIG. 14 shows an alternate spark plug placement suitable for a multicylinder in line engine. In order that spark plugs 29 may be fitted to adjacent cylinders 13 without interfering with each other spark plugs 29 are offset from crankshaft axis 39. Spark plugs 29 on adjacent cylinders 13 are offset in the opposite direction. Spark plugs 29 within any one cylinder 13 are positioned diagonally opposite each other.

In practise it has been found that spark plugs 29 may be placed in any position along the length of window 16 and are not required to be diagonally opposite each other. The primary requirement is to have a spark plug nose 40 on both sides of the window with sufficient squish zone 30 radially outboard of spark plug nose 40 to push the flame front into window 16.

The term "comprising" as used herein is used in the inclusive sense of "including" or "having" and not in the exclusive sense of "consisting only of".

The invention claimed is:

1. An axial flow rotary valve internal combustion engine comprising:

at least one rotary valve rotatable about an axis within a bore of a cylinder head, said valve communicating with a respective cylinder in which a piston reciprocates, and an ignition means associated with said cylinder, said rotary valve having an outside diameter less than 0.85 times a diameter of said cylinder, an inlet port extending from an inlet axial opening at one end of said valve and terminating as an inlet peripheral opening in a periphery of said valve, an exhaust port extending from an exhaust axial opening at the opposite end of said valve and terminating as an exhaust peripheral opening in the periphery of said valve, said peripheral openings periodically communicating with said cylinder through a window in said bore as said valve rotates, said window having a first window end proximate to said inlet axial opening and a second window end remote from said inlet axial opening, a combustion chamber formed in a space between a crown of said piston at top dead center and said cylinder head and said valve, said head having a combustion surface surrounding said window and extending to a wall of said cylinder, wherein said window and said valve are substantially centrally disposed about a first plane within which the axis of said cylinder lies, said ignition means comprising first and second spark plugs, each of said spark plugs having a nose located at one end thereof exposed to said combustion chamber through said combustion surface, said noses being disposed on opposite sides of said window within axial extremities of said window, and an intersection point of an axis of each of said spark plugs with said combustion surface is radially inside said wall of said cylinder by a distance of at least 0.1 times the diameter of said cylinder, and said combustion chamber has first and second squish zones, at least a portion of each of said first and second squish zones being between the wall of said cylinder and the nose of each of said first and second spark plugs respectively.

2. An axial flow rotary valve internal combustion engine as claimed in claim 1, wherein an angle between the axis of each of said spark plugs and said first plane is less than 40 degrees.

3. An axial flow rotary valve internal combustion engine as claimed in claim 1, wherein said at least one rotary valve comprises at least two rotary valves and the respective cylinders of said rotary valves are in-line.

4. An axial flow rotary valve internal combustion engine as claimed in claim 1, wherein each of said first and second squish zones extends circumferentially at least 35 degrees either side of a radial line between the axis of said cylinder and the nose of each of said first and second spark plugs respectively.

5. An axial flow rotary valve internal combustion engine as claimed in claim 4, wherein said squish zones form a continuous circumferential squish zone, outside of said window, extending at least between a circle concentric with said cylinder and the wall of said cylinder, where a diameter of said circle is between a width of said window and twice a radial distance from the axis of said cylinder to the outside of the radially outermost of said spark plug noses.

6. An axial flow rotary valve internal combustion engine as claimed in claim 1, wherein an intersection of said first window end with said combustion surface is closer to the axis of said cylinder than an intersection of said first window end with said bore, thus forming a window lip.

7. An axial flow rotary valve internal combustion engine as claimed in claim 6, wherein said window lip has a window lip profile generated by an intersection of said window lip with any plane parallel to said first plane, an angle between a tangent to said window lip profile and said axis being less than 70 degrees over at least 50% of the length of said window lip profile.

8. An axial flow rotary valve internal combustion engine as claimed in claim 1, wherein said inlet peripheral opening has a first opening end proximate to said inlet axial opening, and said inlet port has a throat and a port floor extending from said first inlet end to said inlet axial opening, a distance between said port floor and said axis progressively increasing as said port floor extends away from said throat to said first inlet end, and the distance between said port floor and said axis progressively increasing as said port floor extends away from said throat to said inlet axial opening, wherein a shape of said port floor between said throat and said first inlet end being adapted to direct air flowing adjacent said port floor through said inlet peripheral opening at an angle of less than 60 degrees to said axis.

9. An axial flow rotary valve internal combustion engine as claimed in claim 1, wherein said inlet port has a throat and said inlet peripheral opening has a first opening end proximate to said inlet axial opening, a distance axially from said first opening end to said throat being at least 0.2 times an axial length of said inlet peripheral opening, said inlet port having a port floor extending from said first opening end to said inlet axial opening, a distance between said port floor and said axis progressively increasing as said port floor extends away from said throat to said first opening end, and the distance between said port floor and said axis progressively increasing as said port floor extends away from said throat to said inlet axial opening such that a cross sectional area of said throat is at least 2% less than a cross sectional area of said inlet axial opening, and a port floor profile generated by an intersection of said port floor with any second plane coincident with said axis intersecting said port floor, an angle between a tangent to said port floor profile and said axis being less than 60 degrees over at least 75% of the length of said port floor profile between said first opening end and said throat.

10. An axial flow rotary valve internal combustion engine as claimed in claim 9, wherein a normal area of said inlet peripheral opening is at least 20% greater than the cross sectional area of said throat.

11. An axial flow rotary valve internal combustion engine as claimed in claim 9, wherein an intersection of said first window end with said combustion surface is closer to the axis of said cylinder than an intersection of said first window end with said bore, thus forming a window lip.

12. An axial flow rotary valve internal combustion engine as claimed in claim 11, wherein said window lip has a window lip profile generated by the intersection of said window lip with any third plane parallel to said first plane, an angle between a tangent to said window lip profile and said axis being less than 70 degrees over at least 50% of the length of said window lip profile.

13. An axial flow rotary valve internal combustion engine as claimed in claim 12, wherein said second plane is coincident with a center of said inlet peripheral opening and said third plane is coincident with said first plane, and said port floor profile and said window lip profile have a substantially common tangent at a rotational position of said valve where said second plane is aligned with said first plane.

14. An axial flow rotary valve internal combustion engine as claimed in claim 1, wherein the axial distance between axial extremities of intersections of said window ends with said bore is greater than 0.6 times the diameter of said cylinder.

15. An axial flow rotary valve internal combustion engine as claimed in claim 1, wherein an intersection of said second window end with said bore is axially closer to the wall of said cylinder than an intersection of said first window end with said bore.

16. An axial flow rotary valve internal combustion engine as claimed in claim 1, wherein said sides of said window are substantially parallel to the axis of said cylinder.

17. An axial flow rotary valve internal combustion engine as claimed in claim 1, wherein a width of said inlet peripheral opening is greater than a width of said window.

18. An axial flow rotary valve internal combustion engine as claimed in claim 1, wherein said engine has a high bore stroke ratio.

* * * * *